US007850505B2

(12) United States Patent
Wong

(10) Patent No.: US 7,850,505 B2
(45) **Date of Patent: *Dec. 14, 2010**

(54) FABRIC DIVING STICK

(75) Inventor: Veronica Pui Chung Wong, Hong Kong (HK)

(73) Assignee: Easebon Services Limited, Kwun Tong (HK)

( * ) Notice: Subject to any disclaimer, the term of this patent is extended or adjusted under 35 U.S.C. 154(b) by 0 days.

This patent is subject to a terminal disclaimer.

(21) Appl. No.: 12/721,047

(22) Filed: Mar. 10, 2010

(65) Prior Publication Data

US 2010/0203799 A1 Aug. 12, 2010

Related U.S. Application Data

(63) Continuation of application No. 11/446,709, filed on Jun. 5, 2006, now Pat. No. 7,677,947.

(51) Int. Cl.
*A63H 23/10* (2006.01)
*A63H 23/00* (2006.01)

(52) U.S. Cl. ..... 446/153; 446/267

(58) Field of Classification Search ..... 446/153–165, 446/267; 273/457, 447, 440, 459, 267
See application file for complete search history.

(56) References Cited

U.S. PATENT DOCUMENTS

| | | | |
|---|---|---|---|
| 3,707,289 | A | 12/1972 | Wicks |
| 4,662,627 | A | 5/1987 | Utley |
| 4,666,417 | A | 5/1987 | Hillman |
| 6,220,599 | B1 | 4/2001 | Eisch |
| 6,332,822 | B2 | 12/2001 | Greenberg |

*Primary Examiner*—Kien T Nguyen
(74) *Attorney, Agent, or Firm*—Amster Rothstein & Ebenstein LLP

(57) ABSTRACT

A diving stick of the type that, after being tossed into a swimming pool, sinks to the bottom while maintaining an upright posture so that it be can easily grasped by a diver. The stick includes a soft hollow shank designed to prevent accidental impalement.

26 Claims, 1 Drawing Sheet

FABRIC DIVING STICK

CROSS-REFERENCE TO RELATED APPLICATIONS

This application is a continuation of and claims priority to U.S. patent application Ser. No. 11/446,709, filed Jun. 5, 2006, the content of which is incorporated herein by reference in its entirety.

FIELD OF THE INVENTION

The present invention generally relates to a diving stick, and in particular to a set of diving stick with a body made semi-permanently affixed colored end caps and soft and decorative fabric sleeves.

BACKGROUND OF THE INVENTION

A "diving stick", or a "dive stick", is an amusement device used in swimming pools. Such a stick will generally comprise a long thin buoyant body having a weight at one end that is sufficient to cause the body to sink in water and to stand upright, weight side down, on the bottom of a swimming pool.

Dive sticks are thrown into the water of a swimming pool, where they sink to the bottom and stand vertically on-end. During pay with these sticks in various games and exercises, several swimmers competing either individually against each other or as members of competing teams, dive into the pool and retrieve one or more sticks standing at the pool's bottom. Besides being a form of amusement, such games and exercises improve the abilities of the swimmers to hold their breaths, and improve their underwater swimming skills.

In one dive stick game, differing point values are assigned to each stick, and swimmers obtain a score according to the total value of the sticks they have retrieved. In another game, swimmers or teams are assigned individually sticks and obtain a score equal to the number of their sticks they have retrieved in a single dive. Several of the many other dive stick games are disclosed in U.S. Pat. No. 6,220,599. In many games, the ability for a diver to readily visually recognize the value or type of stick is critical to success in the game.

Originally, such sticks were rigid. Because certain of these long thin rigid sticks, when standing straight up from the pool bottom, posed an impalement risk to divers, the United States Consumer Products Safety Commission imposed a broad recall and subsequent ban of rigid dive sticks. Since that ban, only dive sticks that are flexible and/or malleable have been sold in the United States. According to the Final Rule of the Consumer Product Safety Commission (CPSC) as recited in the Federal Register on Mar. 7, 2001 (Volume 66, Number 45 at pages 13645-13652) " . . . dive sticks and similar articles that maintain a compressive force of less than 5-lbf under the test at Sec. 1500.86(a)(8) are exempt from this banning rule." Flexible and malleable sticks such as those that are exempted are exemplified in U.S. Pat. Nos. 6,332,822 and 6,220,599.

However, such flexible and malleable sticks are still found to have certain disadvantages. Even though passing the 5-lbf compressive force test and posing less of a hazard, those sticks can still pose a certain hazard to a diving swimmer. While being somewhat softer than the original rigid dive sticks, such sticks as disclosed in the '822 and '599 patents are still relatively rigid in comparison to other swimming pool toys. For Instance, the diving sticks shown in FIGS. 1 through 3C and described at Column 3 Line 66 to Column 4 Line 44 of U.S. Pat. No. 6,332,822 employs a body made of polyvinyl chloride or "any material of similar properties of softness and malleability". While such a softness and malleability may pass the current CPSC regulations, there remains in this inventor's opinion a significant likelihood of injury, or at least pain, should a swimmer impact an upstanding diving stick made of such a material during a dive.

And while the body of the diving stick embodiments shown in FIGS. 4 and 5 and described at Column 4 Line 45 to Column 5 Line 6 of that same '822 patent may be made of a fabric, these bodies are filled with a soft stuffing material such as foam or polyfill or "any materials having properties of softness and pliability corresponding" thereto. While such a softness and pliability may pass the current CPSC regulations, there remains in this inventor's opinion a similarly significant likelihood of injury, or at least pain, should a swimmer impact an upstanding diving stick made of such a material during a dive.

Additionally, although they are somewhat bendable, such sticks as taught in the '822 patent and elsewhere in the prior art must be packaged and stored in a straight shape or else they are prone to becoming permanently bent and disfigured.

And, such sticks are relatively expensive to manufacture.

It is therefore an object of the present invention to provide a diving stick which overcomes the above described drawbacks of the prior art and is safer, less expensive to manufacture, and less susceptible to damage by packaging.

Further, it is an object of the present invention to provide a set of diving sticks that more easily enable recognition between the sticks of the set by allowing using materials that offer greater ornamental flexibility, a wider range of color and decorative combinations, and easy interchangeability between the visible components.

Further, it is an object of the present invention to provide diving sticks whose opposite ends are more similarly shaped and weighted so that the sticks may be grasped at either end and still be properly balanced for throwing while still having the desired imbalance of buoyancy when in the water.

Additional benefits and objects will become apparent to those skilled in the art upon review of the following description of the present invention.

SUMMARY OF THE INVENTION

In exemplary embodiments, a dive stick for use in a swimming pool, can comprise a long thin body comprising a less buoyant end portion, a more buoyant end portion that can be both connected by an intermediary shank portion, and being adapted to sink to and stand upright on the bottom of a swimming pool. The shank portion can comprise a soft fabric tube having a hollow interior and said fabric tube can be semi-permanently affixed to the end portions by a drawstring mechanism.

In exemplary embodiments, said hollow interior can be adapted to receive and contain water as the dive stick sinks and said fabric tube can be porous to allow said water to permeate there-through from said hollow interior upon a compressive external force on the dive stick. Said fabric tube can comprise a pattern having at least two colors.

In exemplary embodiments, said fabric can be a "wrinkle-free" type capable of inherently returning to its original shape without disfigurement after extended periods of folding or crumpling.

In exemplary embodiments, said fabric tube can be made of a synthetic material from the group comprising polyester, nylon, and rayon.

In exemplary embodiments, said fabric tube can be made of a natural material from the group comprising cotton, wool and linen.

In exemplary embodiments, said drawstring can be surrounding each terminal end of said fabric tube, said drawstring being adapted to reduce said tube's diameter when drawn. The end portions can each further comprise a groove for receiving said drawstring, wherein said drawstring can be adapted to fit snuggly within a mating one of said grooves when said drawstring is drawn and to thereby semi-permanently affix that end portion to said fabric tube.

In exemplary embodiments, the end portions can be substantially the same weight as each other, but wherein the less buoyant end portion is negatively buoyant relative to water and the more buoyant end portion is positively buoyant relative to water. Said negatively buoyant end portion can comprise a water intake opening in communication with said hollow interior for allowing water to enter said hollow interior to enable the stick to sink and said positively buoyant end portion can comprise an air escape opening in communication with said hollow interior to allow air to escape from said hollow interior to further enable the stick to sink.

In exemplary embodiments, the end portions can each further comprise a bulbous external grasping surface, both bulbous external grasping surfaces being of substantially the same size and shape.

In exemplary embodiments, said hollow interior can be adapted to receive and contain water and wherein the more buoyant end portion comprises a water intake opening in communication with said hollow interior for allowing water to enter said hollow interior and can thereby enable the stick to sink and the more buoyant end portion comprises an air escape opening in communication with said hollow interior to allow air to escape from said hollow interior and thereby further allow the stick to sink. The end portions can each further comprise a bulbous external grasping surface, both bulbous external grasping surfaces being of substantially the same size and shape.

In exemplary embodiments, the terminal end of said fabric tube can comprise a drawstring-retaining channel. Said drawstring-retaining channel can be created by folded inwardly and sewing said fabric tube. Said drawstring can be inserted in said drawstring-retaining channel.

In exemplary embodiments, the terminal end of said fabric tube can be folded inwardly and sewn to form a drawstring-retaining channels, through which said drawstring is inserted.

In exemplary embodiments, said fabric tube can be semi-permanently affixed to the end portions such that said drawstring mechanism substantially inhibits the affixed fabric tube from being released from the end portions.

In exemplary embodiments, said fabric tube can be semi-permanently affixed to the end portions such that said drawstring mechanism is fastened by prohibiting movement of the drawstring in at least one direction.

In exemplary embodiments, said fabric tube can be semi-permanently affixed to the end portions such that said drawstring mechanism is fastened prevented said drawstring from being pulled in a direction loosening said drawstring.

In exemplary embodiments, said fabric tube can be semi-permanently affixed to the end portions such that said drawstring mechanism is fastened and the resulting loop may only be pulled tighter.

In exemplary embodiments, said drawstring mechanism can be tied in a knot. Said knot can prevent the drawstring from being pulled back such that the resulting loop may only be pulled tighter.

In exemplary embodiments, said drawstring mechanism can semi-permanently affix said fabric tube to the end portions by a one way knot and/or cable tie type knot.

BRIEF DESCRIPTION OF THE DRAWINGS

The features and advantages of the present invention will be more fully understood with reference to the following, detailed description of exemplary embodiments of the present invention when taken in conjunction with the accompanying figures, wherein.

DETAILED DESCRIPTION OF THE EXEMPLARY EMBODIMENTS

Figure 1:
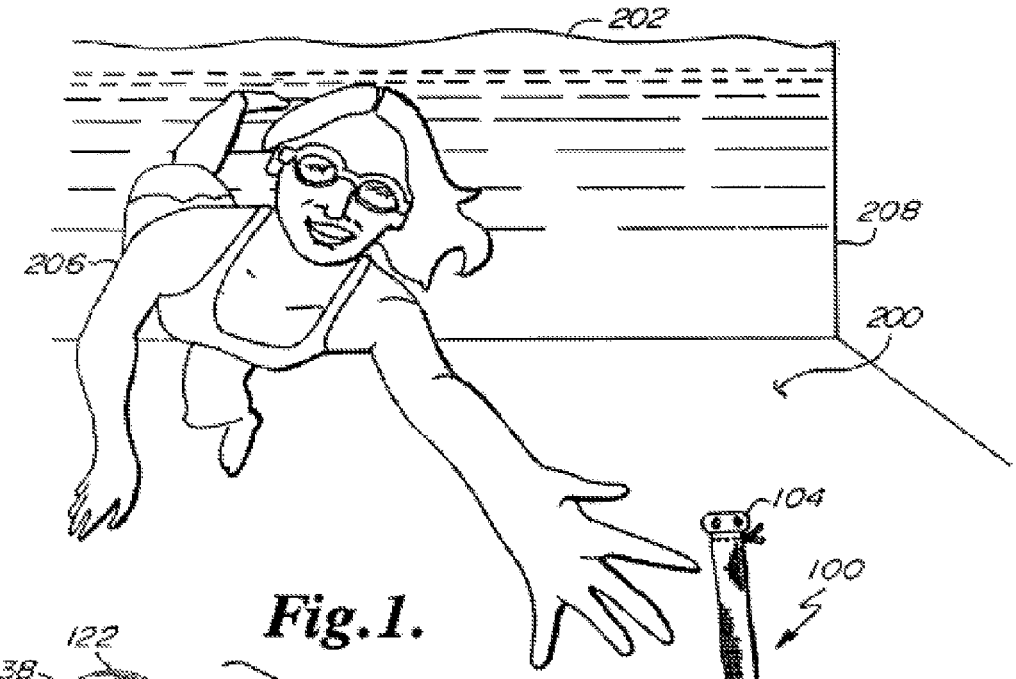
FIG. 1 is a view of a swimmer retrieving a dive stick according to the preferred embodiment of the present invention.
Figure 1:
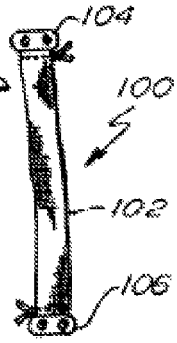
Figure 2:
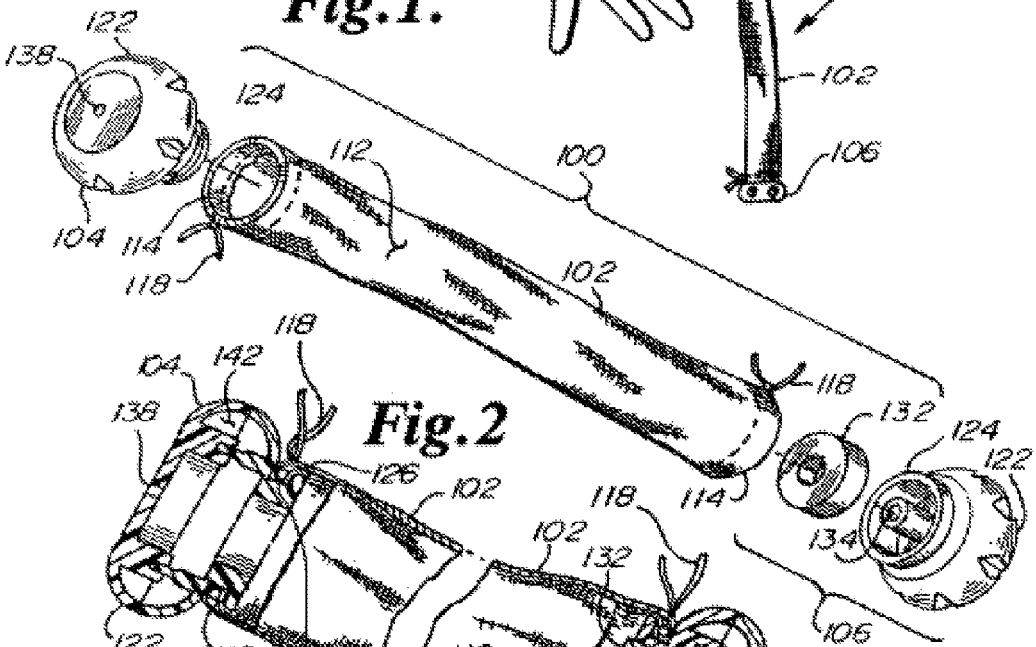
FIG. 2 is an exploded view of the dive stick of FIG. 1.
Figure 3:
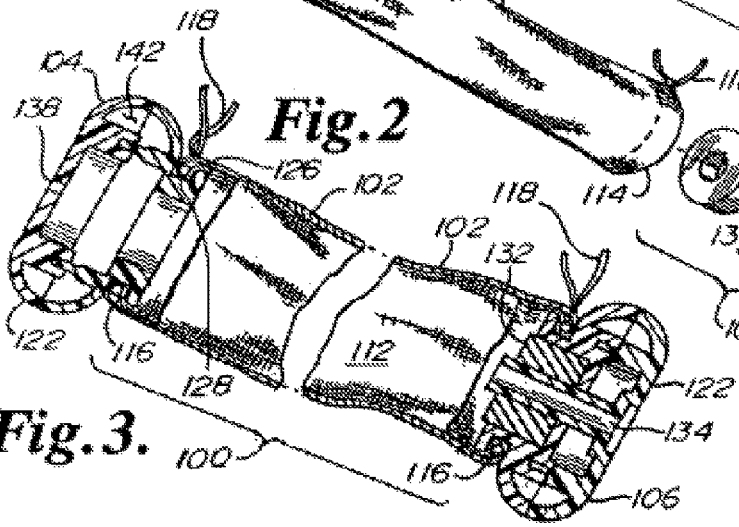
FIG. 3 is a broken cross-sectional view through the dive stick of FIG. 1.

As illustrated in FIGS. 1 through 3, the diving stick 100 of the preferred embodiment of the invention includes a tubular elongate body 102, an upper end cap portion 104, and a lower end cap portion 106. Preferably, the sticks are sold in sets comprising an even number of sticks, one half of the number being decorated and/or colored differently than the other half, so that each half may be assigned to a different team of users when using the sticks in a team-competing game.

Tubular elongate body 102 comprises a soft, flexible and resilient fabric sleeve 112 that is 6¾ inches long and approximately ⅝ inches in diameter and preferably made of a porous cloth material.

The cloth is preferably a polyester knit material, chosen for its softness, its ability to be easily woven, painted or dyed with decorative patterns, its porosity and water permeability, and its resilience to recover its shape after long periods of folding or crumpling such as during packaging. Other "wrinkle-free" synthetic fabric materials, such as nylon or rayon, may be used in cases where the sticks will be folded or crumpled into a shipping package, or a natural fabric material, such as cotton may be acceptable such as in the case where the stick will be packaged in a flat and unwrinkled state, such as in a display pack.

The cloth is preferably painted, printed or woven with a decorative pattern or design on its external surface that is both bright and attractive. Preferably, a water-based non-lead paint is used to apply the pattern to the cloth prior to being formed into the sleeve, which paint and method of application are found to avoid blocking of the fabrics pores to thereby enhance permeability. Aside from their ornamental value, the patterns are intended to aid in visibility by swimmers searching for the sticks underwater, and to ease identification in comparison to sticks bearing different patterns or designs, so that for instance during team-competitive games, players can readily recognize the sticks that are "owned" by their team. As an example, one half of the sticks in a set might have a fine yellow pattern on a dominating red background while the other half may have a fine red print on a dominating yellow background. The terminal ends 114 of sleeve 112 are folded inwardly and sewn to form drawstring-retaining channels 116, through which are inserted drawstrings 118.

End caps 104 and 106 are molded of a plastic, preferably ABS, which is less dense than water, in a bright and decorative color that both compliments the coloring of sleeve 112 and eases visibility and identification of the sticks comparison to sticks bearing differently colored end caps. For instance the half of the sticks in the set that has the red sleeve background color may have yellow-colored end caps while the half that has the yellow sleeve background may have red-colored end caps, so that sticks of either half of the set are both readily visible to swimmers, and can be easily and quickly distinguished from the other sticks during play.

Both upper end cap 104 and lower end cap 106 comprise bulbous portion 122 and neck portion 124. Bulbous portions 122 of both end caps are substantially identical in external diameter of approximately 1 3/16 inches and substantially spherical shape and are thereby adapted for comfortable grasping by the user, and to provide both balance for throwing and mass for sinking when the stick is thrown into the water of a swimming pool. Neck portions 124 both comprise a shaft 126 having a diameter of approximately 5/8 inch for inserting into one of the terminal ends 114 of sleeve 112 and a groove 128 thereon adapted to receive the tightened drawstring 118 after the shaft has been so inserted, to ensure that the end caps cannot inadvertently slip out of the sleeve during use of the stick.

Drawstring 118 is preferably tied in a knot after tightening to semi-permanently affix the end caps to the sleeve, however, it is one inventive aspect of this diving stick that the user may "mix and match body portions and end caps by untying and loosening the drawstrings and swapping end caps of one color into sleeves of another color. This enables an increase in the number of subsets of sticks for games wherein more than two teams are competing. For example, a first team may "own" sticks that have a dominantly red sleeve and yellow end caps, and a second team may "own" sticks that have a dominantly yellow sleeve and red end caps, while a third team may "own" sticks that have a dominantly red sleeve and red end caps, and a fourth team may "own" sticks that have a dominantly yellow sleeve and yellow end caps. All of these coloring arrangements are very visible, yet easily and instantly distinguishable, and all may be readily arranged for the two end cap color variations and two sleeve pattern variations provided in the stick set.

Lower end cap 106 further comprises ballast 132, which is preferably made of a non-corrosive metal and which causes lower end cap 106 to be only insignificantly heavier than upper end cap 104 when above the water to thereby cause no significant imbalance during throwing, yet which causes lower end cap 106 to be substantially denser than upper end cap 104 so that the stick will always sink in the water with the lower end cap sinking first and pulling the stick 100 down in the water and the stick 100 will always come to rest with the lower end cap 106 on the pool bottom.

Initially as stick 100 is cast into the water, the hollow interior of the sleeve 112 is filled with air and the stick is positively buoyant and floats at the water surface 202. Lower end cap 106 further comprises water intake channel 134, which allows water to enter the hollow interior portion of the sleeve and the stick to thereby become negatively buoyant and gradually sink towards the bottom surface 200 of the pool.

Upper end cap 104 is only insignificantly less heavy than upper end cap 106 when above the water to thereby cause no significant imbalance during throwing. Upper end cap 104 comprises temporary air-holding cavity 136 which communicates to the outside of the stick through air escape channel 138 and permanent air-holding cavity 142, which is adapted to hold just enough air to render the upper end cap slightly positively buoyant when the temporary air-holding cavity 136 has filled with water, but which does not hold enough air to render the entire stick positively buoyant even when temporary air-holding cavity 136 and the sleeve 112 have filled with water.

Regardless of the specific material used to make the end caps, it is an important aspect of the invention that upper end cap 104 is less dense than water and that lower end cap 106 is not only denser than water, but also heavy enough to overcome any positive buoyancy of the remainder of stick 100 as the stick becomes water-filled. This ensures that the stick 100 will be pulled to the floor 200 of the pool 208 by the weight of lower end cap 106, and will assume a standing posture on the pool floor with lower end cap 106 on the pool floor and upper end cap 104 aiming upwardly and ready for grasping by a swimmer 206.

The sinking process of stick 100 begins immediately after the stick is cast into the pool water, as water begins to enter the stick's interior through water intake channel 134 and sleeve 112, and air begins to exit the stick through air escape channel 138. This flow pattern of water only coming in through channel 134 and sleeve 112 and air escaping through channel 138 is caused by the tendency of denser lower end cap 106 to immediately start to sink while buoyant upper end cap 104 remains at the water surface 202. As the sleeve becomes more and more water-filled, the stick begins to sink in the pool, with the lower end cap 106 sinking first.

Upper end cap 104 is substantially less dense than lower end cap 106, particularly when first thrown into the water and temporary air-holding cavity 136 is filled with air, so that the stick will always sink in the water with the upper end cap raised towards the water surface 202. And because the permanent air-holding cavity 142 renders the upper end cap slightly positively buoyant, the stick 100 will always come to rest with the upper end cap directed upwardly from the pool bottom and the stick 100 standing vertically as shown in FIG. 1.

Numerous games of play and exercises are well-known for use of diving sticks, generally requiring a swimmer 206 to dive into a swimming pool 208 and collect one of more sticks which have previously been cast into the water and which stand on the pool's bottom surface. It should be appreciated that the porosity of the fabric of sleeve 112 of sticks made according to the present invention provides a safety system for allowing the stick to be easily compressed when impacted under water. When so impacted, water flows rapidly out through the sleeve's fabric and this renders the stick far more easily and instantly compressible that sticks of the prior art, so that even if a diver is to impact an upstanding stick straight-on, he cannot be impaled and is far less likely to be injured.

It should also be appreciated that the foregoing is merely one of numerous possible embodiments of the present invention, is meant only to teach that embodiment currently preferred by the inventor, and is not intended to limit the scope of the invention in any way. Such limitations should be determined by the elements of the following claims, including equivalents thereto.

What is claimed is:

1. A dive stick for use in a swimming pool, comprising:

a long thin body comprising a less buoyant end portion, a more buoyant end portion both connected by an intermediary shank portion, and being adapted to sink to and stand upright on the bottom of a swimming pool, wherein the shank portion is comprised of a soft fabric tube having a hollow interior; and wherein said fabric tube is semi-permanently affixed to the end portions by a drawstring mechanism.

2. The dive stick of claim 1 wherein said hollow interior is adapted to receive and contain water as the dive stick sinks and said fabric tube is porous to allow said water to permeate there-through from said hollow interior upon a compressive external force on the dive stick.

3. The dive stick of claim 2 wherein said fabric tube comprises a pattern having at least two colors.

4. The dive stick of claim 1 wherein said fabric is a "wrinkle-free" type capable of inherently returning to its original shape without disfigurement after extended periods of folding or crumpling.

5. The dive stick of claim 1 wherein said fabric tube is made of a synthetic material from the group comprising polyester, nylon, and rayon.

6. The dive stick of claim 1 wherein said fabric tube is made of a natural material from the group comprising cotton, wool and linen.

7. The dive stick of claim 1 wherein said drawstring is surrounding each terminal end of said fabric tube, said drawstring being adapted to reduce said tube's diameter when drawn.

8. The dive stick of claim 7 wherein the end portions each further comprise a groove for receiving said drawstring, wherein said drawstring is adapted to fit snuggly within a mating one of said grooves when said drawstring is drawn and to thereby semi-permanently affix that end portion to said fabric tube.

9. The dive stick of claim 1 wherein the end portions are of substantially the same weight as each other, but wherein the less buoyant end portion is negatively buoyant relative to water and the more buoyant end portion is positively buoyant relative to water.

10. The dive stick of claim 9 wherein said negatively buoyant end portion comprises a water intake opening in communication with said hollow interior for allowing water to enter said hollow interior to enable the stick to sink and said positively buoyant end portion comprises an air escape opening in communication with said hollow interior to allow air to escape from said hollow interior to further enable the stick to sink.

11. The dive stick of claim 10 wherein the end portions each further comprise a bulbous external grasping surface, both bulbous external grasping surfaces being of substantially the same size and shape.

12. The dive stick of claim 1 wherein said hollow interior is adapted to receive and contain water and wherein the more buoyant end portion comprises a water intake opening in communication with said hollow interior for allowing water to enter said hollow interior and thereby enable the stick to sink and the more buoyant end portion comprises an air escape opening in communication with said hollow interior to allow air to escape from said hollow interior and thereby further allow the stick to sink.

13. The dive stick of claim 12 wherein the end portions each further comprise a bulbous external grasping surface, both bulbous external grasping surfaces being of substantially the same size and shape.

14. The dive stick of claim 1, wherein the terminal end of said fabric tube is comprising a drawstring-retaining channel.

15. The dive stick of claim 14, wherein said drawstring-retaining channel is created by folded and sewing said fabric tube.

16. The dive stick of claim 14, wherein said drawstring is inserted in said drawstring-retaining channel.

17. The dive stick of claim 1, wherein the terminal end of said fabric tube are folded and sewn to form a drawstring-retaining channels, through which said drawstring is inserted.

18. The dive stick of claim 1, wherein said fabric tube is semi-permanently affixed to the end portions such that said drawstring mechanism substantially inhibits the affixed fabric tube from being released from the end portions.

19. The dive stick of claim 1, wherein said fabric tube is semi-permanently affixed to the end portions such that said drawstring mechanism is fastened by prohibiting movement of the drawstring in at least one direction.

20. The dive stick of claim 1, wherein said fabric tube is semi-permanently affixed to the end portions such that said drawstring mechanism is fastened prevented said drawstring from being pulled in a direction loosening said drawstring.

21. The dive stick of claim 1, wherein said fabric tube is semi-permanently affixed to the end portions such that said drawstring mechanism is fastened and the resulting loop may only be pulled tighter.

22. The dive stick of claim 1, wherein said drawstring mechanism is tied in a knot.

23. The dive stick of claim 22, wherein said knot prevents the drawstring from being pulled back such that the resulting loop may only be pulled tighter.

24. A dive stick for use in a swimming pool, comprising:

a long thin body comprising a less buoyant end portion;

a more buoyant end portion both connected by an intermediary shank portion, and being adapted to sink to and stand upright on the bottom of a swimming pool;

wherein the shank portion is comprised of a soft fabric tube having a hollow interior;

wherein said hollow shank portion is sufficiently flexible to be compactly crumpled, while being sufficiently resilient to return automatically to its pre-crumpled shape; and wherein said fabric tube is semi-permanently affixed to the end portions and further comprises a mechanism for semi-permanently affixing the end portions to fasten said fabric tube thereto; and said mechanism is a drawing surrounding each terminal end of said fabric tube, said drawings being adapted to reduce said tubes diameter when drawn.

25. The device stick of claim 24, wherein the end portions each further comprise a groove for receiving said drawstrings, wherein each of said drawstrings is adapted to fit snuggly within a mating one of said grooves when said drawstring is drawn and to thereby semi-permanently affix that end portion to said fabric tube.

26. The device stick of claim 25, wherein said fabric tube is only removable from that mating end portion when that drawstring is not drawn into said mating groove.

* * * * *